US006464091B1

(12) United States Patent
Nagasaki

(10) Patent No.: US 6,464,091 B1
(45) Date of Patent: Oct. 15, 2002

(54) COLLAPSIBLE WALL UNIT FOR CLOTHES

(76) Inventor: Daniel George Nagasaki, 501 Sunset Beach Road, Richmond Hill, Ontario (CA), L4E 3J3

( * ) Notice: Subject to any disclaimer, the term of this patent is extended or adjusted under 35 U.S.C. 154(b) by 0 days.

(21) Appl. No.: 09/653,485

(22) Filed: Aug. 31, 2000

(51) Int. Cl.[7] ..... A47F 5/00
(52) U.S. Cl. ..... 211/104; 211/1.3; 211/99
(58) Field of Search ..... 211/1.3, 104, 105.1, 211/123, 99

(56) References Cited

U.S. PATENT DOCUMENTS

| | | | | |
|---|---|---|---|---|
| 1,716,923 A | * | 6/1929 | Lindquist | |
| 2,317,437 A | * | 4/1943 | Botta | |
| 2,672,241 A | * | 3/1954 | Cohen et al. | |
| 3,285,423 A | * | 11/1966 | Bar-Giora | 211/1.3 |
| 3,420,488 A | * | 1/1969 | Sisler | |
| 4,171,748 A | * | 10/1979 | Fabian | 211/1.3 |
| 4,632,255 A | * | 12/1986 | Kennedy | 211/1.3 |
| 5,181,685 A | * | 1/1993 | Ostapowicz | 211/105.1 X |
| 5,950,845 A | * | 9/1999 | Harris | 211/99 X |

FOREIGN PATENT DOCUMENTS

| | | |
|---|---|---|
| CA | 1053643 | 5/1979 |
| CA | 1116578 | 1/1982 |
| CA | 1138385 | 12/1982 |
| CA | 1157430 | 11/1983 |
| CA | 1173796 | 9/1984 |
| CA | 2068524 | 11/1990 |
| CA | 2078674 | 3/1991 |
| CA | 2174535 | 7/1994 |
| CA | 2166658 | 1/1996 |

* cited by examiner

*Primary Examiner*—Robert W Gibson
(74) *Attorney, Agent, or Firm*—David P. Gordon; David S. Jacobson; Thomas A. Gallagher

(57) ABSTRACT

There is described a collapsible wall unit for clothes which has at least one frame unit which is of generally triangular shape and consists of a first plate portion, a rod portion, and a second plate portion. A rail can be positioned between the frame units and used to support clothes. Alternatively, clothes can be hung on the rod portion of a single frame unit. When not in use, the frame unit can be disassembled and rests against the wall.

9 Claims, 4 Drawing Sheets

COLLAPSIBLE WALL UNIT FOR CLOTHES

FIELD OF THE INVENTION

This invention relates to a wall unit for clothes. More particularly this invention relates to a collapsible wall unit which lies flush against a wall when not in use and extends upon use.

BACKGROUND OF THE INVENTION

Home owners and apartment dwellers often have difficulty in organizing their wardrobes.

Most homes and apartments are provided with permanent closets. These closets frequently do not provide enough space for the owner's clothes, and additional storage space would be desirable.

In other cases, these permanent closets are not needed and, in fact, take up usable space.

Several alternatives currently available in the marketplace for this purpose are ' over-the-door ', hanging door racks and garment racks. However, these methods are often cumbersome and unattractive.

Outside people employed clotheslines using either a pulley system or use a stationary apparatus often set in the ground. These effectively limited one's use of the garden and provided unsightly rows of drying clothes.

It would be advantageous to provide a wardrobe which can be used either on a temporary or a permanent basis depending upon the owner's needs.

SUMMARY OF THE INVENTION

It is an object of the present invention to provide a collapsible wall unit for clothes.

Accordingly, there is provided a collapsible wall unit for clothes which has at least one frame unit, comprising, a first plate portion having a top end and a bottom end, a rod portion having a first end and a second end, the first end being hinged with the bottom end of said first plate portion; a second plate portion, having a top end and a bottom end, capable of being, in use, affixed to a wall in a substantially vertical orientation, the top end of said second plate portion hingeably engaging the top end of the first plate portion; said second plate portion having a recess for engaging the second end of the rod portion.

A substantially vertical channel can be provided in the second plate portion for engaging the second end of the rod portion, with an optional entry slot provided to receive the second end of the rod portion.

Where two or more frame units are used, a rail can be positioned between the frame units to permit clothes to be hung on the rail. The rail could rest on the rod portions of the frame units, or the rail could be provided with a hole or slot at each end into which the rod portion could be inserted for a more secure fit.

A number of advantages of the collapsible wall unit will be readily apparent.

The collapsible wall unit can lie flush against the wall when not in use and can thus provide permanent or temporary hanging space.

The wall unit can be used to hang clothes in any areas where people have limited space and are trying to maximize space.

The collapsible wall unit can be used anywhere. For example, the wall unit can be used in the laundry room to dry clothes or hold ironed clothes. Alternately, the wall unit can be used outside for drying and freshening clothes. Other possible locations include mud rooms, studios, bedrooms, offices, garages, cottages, recreational vehicles, yachts, hotels, motels, dormitories, restaurants, hospitals and the like.

BRIEF DESCRIPTION OF THE DRAWINGS

Embodiments of the invention will now be described, by way of example, with reference to the following drawings in which:

FIG. 1*a* is a view similar to FIG. 1 illustrating an alternative embodiment.

The same reference numerals are used for like parts throughout.

DETAILED DESCRIPTION

Figure 1:
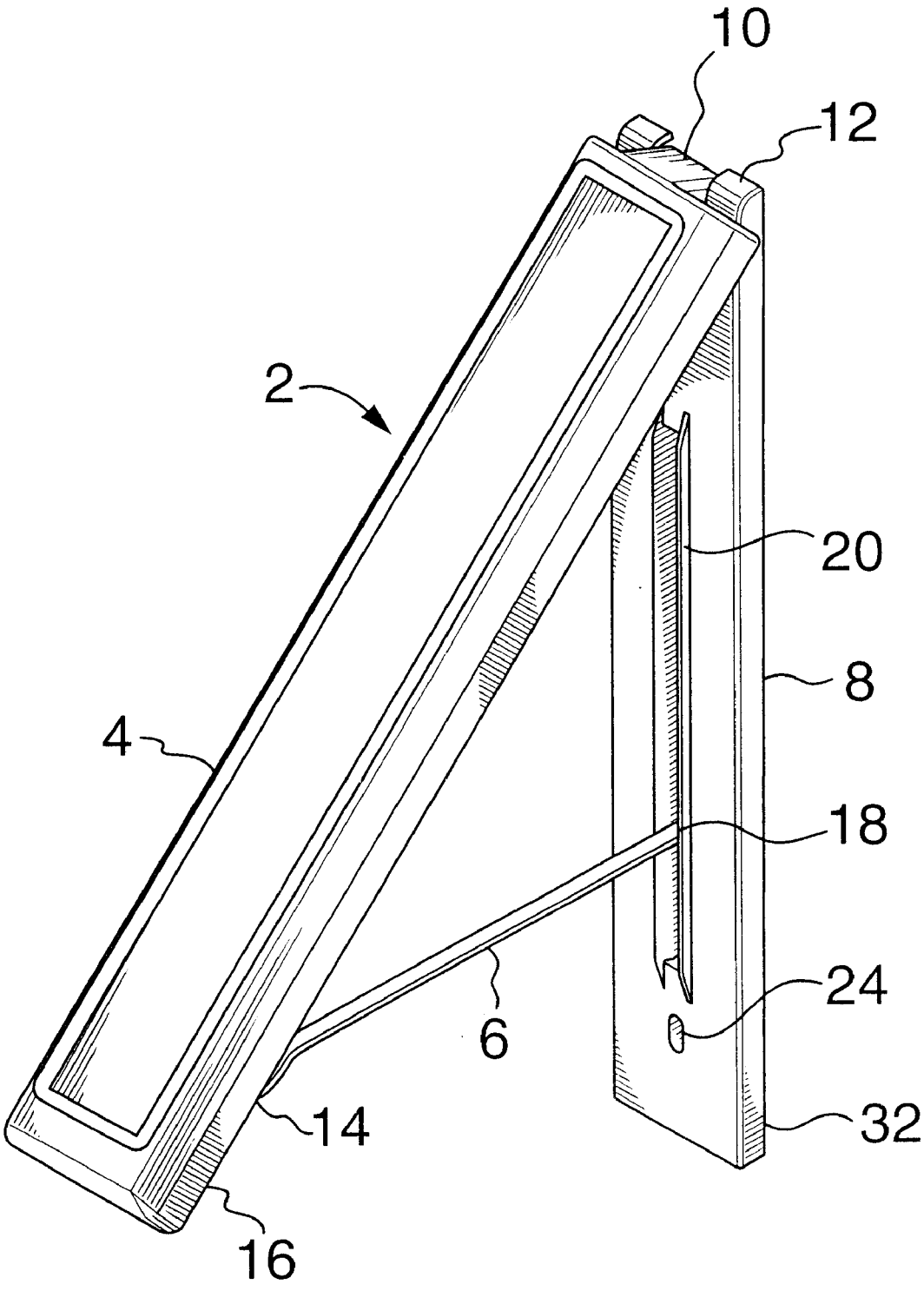
FIG. 1 is a perspective view of the wall unit frame according to e embodiment of the invention.

Referring to FIG. 1, the collapsible wall unit has at least one frame unit 2 which is of generally triangular shape and consists of three parts: a first plate portion 4, a rod portion 6, and a second plate portion 8.

The first plate portion 4 is hingedly engaged along its top end 10 with the top end 12 of the second plate portion 8.

The rod portion 6 is hinged at its first end 14 with the bottom end 16 of the first plate portion 4, while the second end 18 of the rod portion 6 is engaged in a recess 20 in the second plate portion 8.

Figure 2:
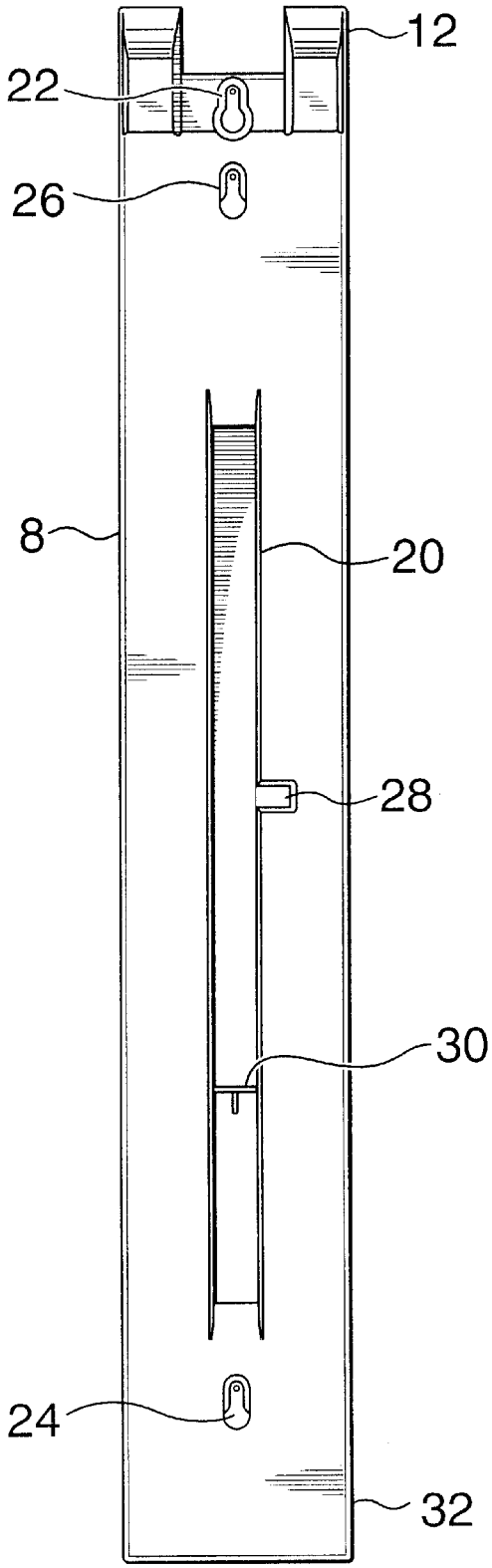
FIG. 2 is a front view of the second plate portion according to one embodiment of the invention.

Referring to FIG. 2, the second plate portion is affixed to a wall (not shown), preferably by means of screws (not shown) through two holes 22 and 24 which are at the top and bottom of the second plate portion 8.

According to one embodiment of the invention, the second plate portion 8 is provided with a substantially vertical channel 20 in which the second end 18 of the rod portion 6 may be slidably positioned. Preferably, the channel 20 is slightly narrower than the width of the end of the rod 6, and the channel is provided with an entry slot 28 which receives the rod 6. In this manner, the rod 6 is slidable within the channel 20 but can only enter or exit the channel 20 via the entry slot 28.

A lip or cavity 30 could be provided to receive the rod 6 when it is at the bottom of the channel 20 so that the rod 6 is inclined to remain in position.

According to a manufactured embodiment of the invention, the dimensions of the second plate portion 8 were 9.5 cm wide and 55.25 cm high (including hinge) with the top and bottom screw holes 22 and 24 being located approximately 4.7 cm from the ends 12 and 32 of the second plate portion 8.

The first plate portion 4 is generally of the same size and shape as the second plate portion 8 and is adapted to hinge along its top end 10 with the top end 12 of the second plate portion 8.

A number of hinges are known and could be used. For example, the first plate portion 4 and second plate portion 8 could be of unitary construction and have a crease (not shown) at which point the first plate portion 4 and second plate portion 8 would hinge.

Alternatively, there could be provided a metal rod (not shown) which passes through the top end 10 of the first plate portion 4 and second plate portion 12 to allow the two parts to hinge.

According to the embodiment shown in FIG. 1, the top end 10 of the first plate portion 4 is provided with a T-shaped arm (not shown) which is adapted to fit within a corresponding cavity in the top end 12 of the second plate portion 8.

The rod portion 6 is hingedly attached at its'first end 14 to the bottom end of the first plate portion 16. The second end 18 is adapted to slide within the substantially vertical channel 20 of the second plate portion 8.

Alternatively, as shown in FIG. 1*a,* the second end 18 of the rod 6 of could be adapted to fit within a corresponding recess in the second plate portion 8 such as a half-round trim ring 20.

Figure 3:
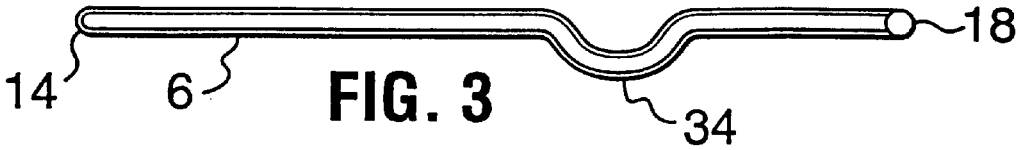
FIG. 3 is a side view of the rod portion according to one embodiment of the invention.
Figure 4:
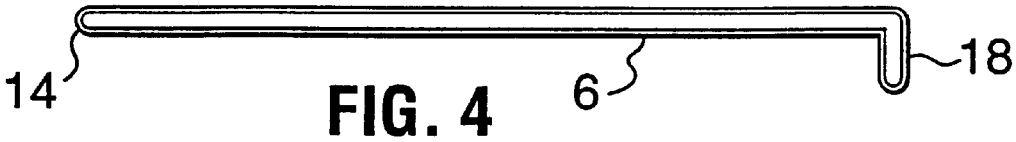
FIG. 4 is a top view of the rod portion of FIG. 3.

Referring to FIGS. 3 and 4 the rod 6 is provided with one or more depressions 34 along its length and has an L-shaped end 18.

Figure 5:
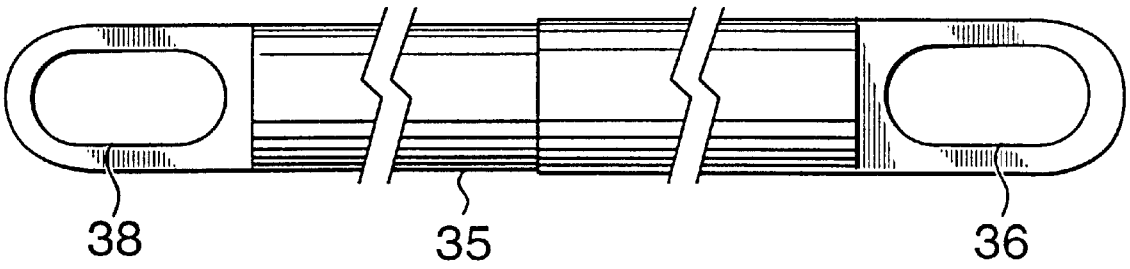
FIG. 5 is a side view of the rail according to one embodiment of the invention.
Figure 6:
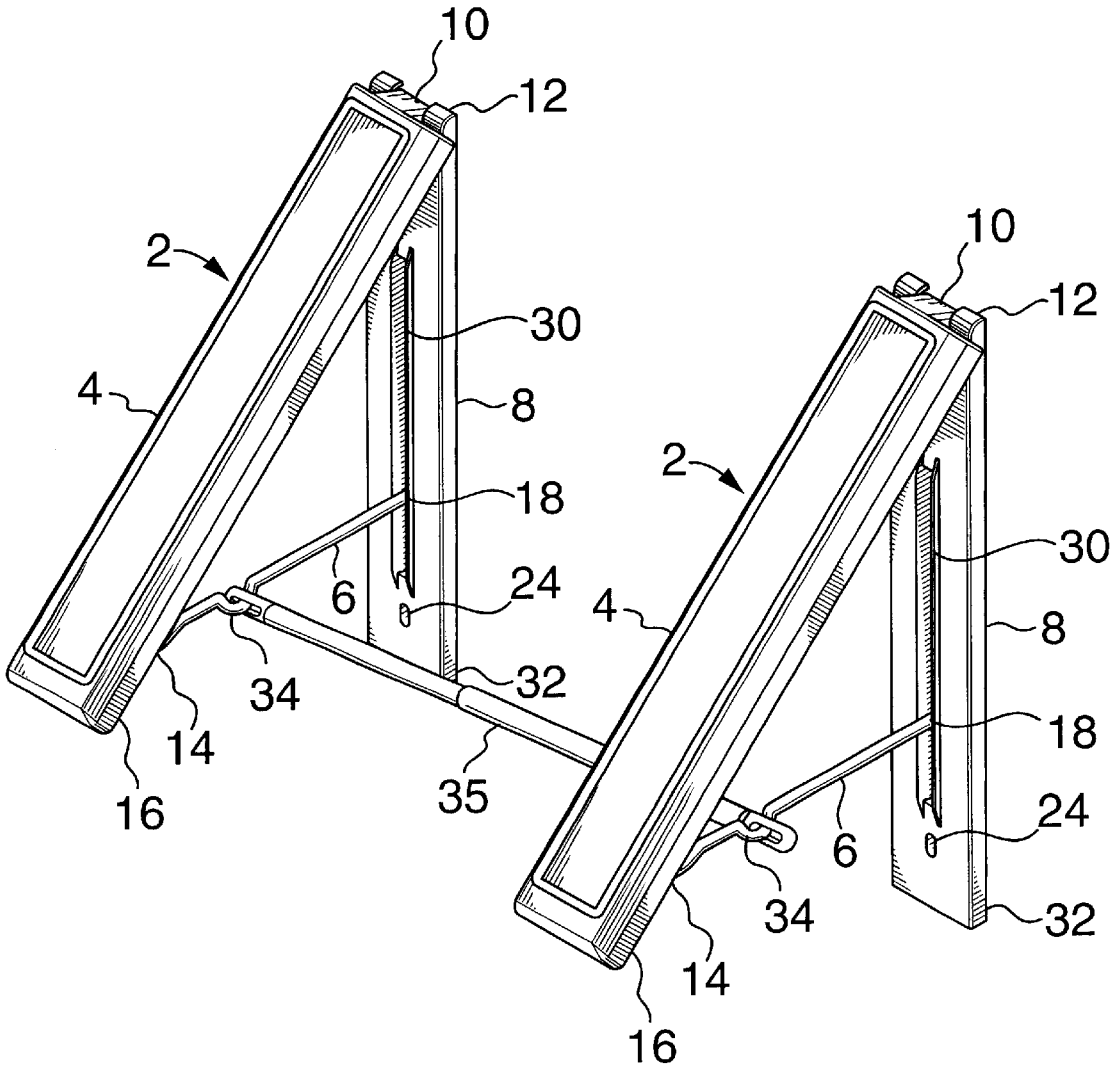
FIG. 6 is a perspective view of another embodiment using two frames.

Referring to FIG. 5 a substantially horizontal rail 35 having two slots 36 and 38 through which the respective rod portion 6 of two or more frame units 2 could be passed, whereby the rail 35 would rest in the depressions 34 of the rod portions 6 as shown in FIG. 6.

Alternatively, the rail 35 could rest freely on top of the depression 34 of the rod portion 6 of two or more frame units 2.

According to a further embodiment of the invention, the rail 35 could be telescopic by having two corresponding sections to allow for a variable length of the rail 35.

It is intended that a number of frame units 2 would be affixed along a wall (not shown), preferably with 48" to 72" between each frame unit 2. The rail 35 would then be used to provide the resting rail on which clothes would be hung.

A third optional screw hole 26, as shown in FIG. 2, can be provided for use as reinforcement where the rail (and two frame units 2) are installed in a hollow dry wall installation.

An optional door mounting bracket (not shown) could be provided to allow the frame units 2 to be fastened to the rear side top of the second plate portion 8. Two nuts, bolts, washers would be supplied to fasten the bracket to the frame unit 2 by utilizing the two mounting holes 22 and 26 at the top of the second plate portion. This will enable the user to hang the wall unit from the top of a door (not shown) as opposed to fastening the frame unit to a wall (not shown). It will be sold in two sizes to accommodate the two standard door thicknesses that being 1¾" & 1⅜".

It will be readily apparent to a person skilled in the art that a number of variations and modifications can be made without departing from the true spirit of the invention which will now be pointed out in the appended claims.

I claim:

1. A collapsible wall unit for clothes, comprising:

at least one frame unit, including, (i) a first plate portion having a top end and a bottom end;

(ii) a rod portion having a first end and a second end, the first end being hinged with the bottom end of said first plate portion; and (iii) a second plate portion, having a top end and a bottom end, capable of being, in use, affixed to a wall in a substantially vertical orientation, the top end of said second plate portion hingeably engaging the top end of the first plate portion, said second plate portion having a recess for engaging the second end of the rod portion, wherein one of said first plate portion and said second plate portion is rectangular; and the second end of the rod portion is L-shaped.

2. The collapsible wall unit according to claim 1, wherein:

the recess in said second plate portion is a substantially vertical channel, and said second end of the rod portion is adapted to fit the substantially vertical channel and move within said channel.

3. The collapsible wall unit according to claim 2, wherein:

the second end of the rod portion is wider than the substantially vertical channel, and said channel has an entry slot for receiving the second end of the rod portion, such that the second end of said rod portion is slidably engaged within said channel.

4. The collapsible wall unit according to claim 1, wherein: the recess in said second plate portion is a half-round trim ring.

5. The collapsible wall unit according to claim 1, further comprising:

a rail, wherein said at least one frame unit is at least two frame units, and said rail rests on the rod portion of each frame unit.

6. The collapsible wall unit according to claim 1, further comprising:

a rail having two ends each of which has a hole, wherein said at least one frame unit is at least two frame units, and said hole at each said end of said rail is of sufficient diameter to allow the rod portion of each frame unit to pass through said hole such that the rail rests on the rod portions.

7. The collapsible wall unit according to claim 6, wherein; the hole is a slot.

8. A collapsible wall unit according to claim 1, wherein: said first plate portion is rectangular.

9. A collapsible wall unit according to claim 1, wherein: said second plate portion is rectangular.

* * * * *